US007900979B2

(12) United States Patent
Bragg et al.

(10) Patent No.: US 7,900,979 B2
(45) Date of Patent: Mar. 8, 2011

(54) LOW POWER CONSUMPTION LOCK FOR APPLIANCE LATCH

(75) Inventors: Joel C. Bragg, Waterford, WI (US); Kenyon A. Hapke, Libertyville, IL (US); Michael K. Hintz, Waukesha, WI (US); Randy S. McDonald, Sussex, WI (US); Michael S. Osvatic, Waukesha, WI (US); Jarod M. Sulik, New Berlin, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 1019 days.

(21) Appl. No.: 11/684,287

(22) Filed: Mar. 9, 2007

(65) Prior Publication Data

US 2007/0144880 A1 Jun. 28, 2007

(51) Int. Cl.
*E05C 1/02* (2006.01)

(52) U.S. Cl. ..... 292/137; 292/251.5; 292/DIG. 69; 292/144

(58) Field of Classification Search ..... 292/251.5, 292/DIG. 69, 144, DIG. 66, DIG. 22, DIG. 26, 292/137, 334, 180, 341.15, 341.16; 126/190–192, 126/197; 335/186; 70/277, 278.6, 280, DIG. 52, 70/278.7; 68/12.26; 134/57 DL, 58 DL
See application file for complete search history.

(56) References Cited

U.S. PATENT DOCUMENTS

| | | | | |
|---|---|---|---|---|
| 2,767,011 | A * | 10/1956 | Buckley | 292/341.16 |
| 4,314,217 | A * | 2/1982 | Krasser | 335/188 |
| 4,932,707 | A * | 6/1990 | Ekstran | 292/341.17 |
| 5,249,831 | A | 10/1993 | Maniaci | |
| 5,813,257 | A * | 9/1998 | Claghorn et al. | 70/208 |
| 6,290,270 | B1 | 9/2001 | Spiessl | |
| 6,334,637 | B1 * | 1/2002 | Chioffi | 292/341.16 |
| 6,474,119 | B1 * | 11/2002 | Halvorson et al. | 70/208 |
| 6,525,644 | B1 * | 2/2003 | Stillwagon | 340/5.61 |
| 6,615,623 | B1 * | 9/2003 | Ormerod | 70/224 |
| 6,634,684 | B2 * | 10/2003 | Spiessl | 292/341.16 |
| 6,743,986 | B2 | 6/2004 | Dirnberger | |
| 6,840,553 | B2 | 1/2005 | Dirnberger et al. | |
| 6,867,685 | B1 * | 3/2005 | Stillwagon | 340/5.64 |
| 7,076,976 | B1 | 7/2006 | Goldman | |
| 2002/0101313 | A1 | 8/2002 | Dirnberger et al. | |
| 2005/0194795 | A1 | 9/2005 | Hapke et al. | |

FOREIGN PATENT DOCUMENTS

| | | | |
|---|---|---|---|
| DE | 8700199 | U1 | 2/1987 |
| DE | 19601228 | A1 | 7/1997 |
| DE | 19852578 | C1 | 4/2000 |
| EP | 0 854 260 | A1 | 7/1998 |
| EP | 1371799 | * | 12/2003 |
| FR | 2607295 | A | 5/1988 |
| WO | WO00/29698 | A | 5/2000 |

OTHER PUBLICATIONS

English translation of claims of German Patent No. DE 19601228 A1, published Jul. 17, 1997; Inventor: Dirnberger.

Annex to Form PCT/ISA/206 Communication Relating to the Results of the Partial International Search, PCT Application No. PCT/US2008/052168, dated Aug. 4, 2008, European Patent Office, International Searching Authority., Rijswijk, Netherlands.

* cited by examiner

*Primary Examiner* — Carlos Lugo
*Assistant Examiner* — Kristina R Fulton
(74) *Attorney, Agent, or Firm* — Boyle Fredrickson, S.C.

(57) ABSTRACT

A transportation-robust bi-stable latch mechanism preserves low actuation forces by means of an auxiliary mechanism blocking the effects of shock forces during transportation.

19 Claims, 3 Drawing Sheets

LOW POWER CONSUMPTION LOCK FOR APPLIANCE LATCH

CROSS-REFERENCE TO RELATED APPLICATIONS

--

STATEMENT REGARDING FEDERALLY SPONSORED RESEARCH OR DEVELOPMENT

--

BACKGROUND OF THE INVENTION

The present invention relates to latching mechanisms for the door of a household appliance such as clothes washing machine, and, in particular, to an electrically actuated lock for such a latch.

Appliances such as clothes washing machines and dishwashers may operate automatically through one or more cycles under the control of an automatic timer. During cycles when the consumer might be exposed to spraying water or hazardous moving parts, the door to the appliance may be locked by an electrical signal from the timer. The locking mechanism may, for example, insert a blocking member into a portion of the door latch to prevent it from being disengaged through the normal operation of the latch or may insert a blocking member directly into the door.

The locking mechanism may be actuated by an electrical solenoid having an element that moves through a conductive coil when electrical power is applied to the coil. Alternatively, electrical actuators, such as wax motors and heated bimetallic strips, may be used.

Each of the above mechanisms requires continuous power to remain actuated, typically for the duration of the locked cycle. In the case of a solenoid, this continuous duty requires increased size and expense of the coil windings which must be rated for continuous duty. A disadvantage of wax motors and bimetallic strips is that they rely on a heating process and thus cannot provide rapid locking and unlocking.

These disadvantages can be overcome through the use of an electromagnetically driven bi-stable actuator. Such an actuator may include a bidirectional solenoid that may either push or pull an actuator element depending on polarity of applied electrical power or power being applied to one of two coils. An over-center spring mechanism holds the actuator element in its last position, either locked or unlocked, when power is not applied.

During shipment of an appliance with a bi-stable lock, transportation shocks may cause the lock to move without the application of electrical power, for example, from the unlocked position to the locked position. This unintended locking of the appliance door can be inconvenient for the end user who may need access to the interior of the appliance before the appliance is installed and connected to electrical power, for example, to obtain parts or appliance manuals from the interior of the appliance.

This inadvertent actuation of the bi-stable lock can be eliminated by increasing the force of the over-center spring or adding frictional elements to the latch. This approach, however, necessitates a larger electromagnetic actuator, defeating to some extent the motivation for using a bi-stable actuator. Frictional elements can be difficult to manufacture so that they provide a consistent friction over the life of the product.

BRIEF SUMMARY OF THE INVENTION

The present invention provides a bi-stable lock for an appliance that preserves low actuation forces by using a separate, automatic mechanism that prevents actuation of the lock by transportation shock. In a principal embodiment of the invention, external shocks are sensed and sensed to block or oppose movement of the lock only during the duration of the shock. In a second embodiment of the invention, electrical power is used to un-block or allow movement of the lock only during the application of electrical power.

Specifically then, the present invention provides a latch for a door of a household appliance that is subject to transportation shocks where the latch includes a latch body and a bi-stable actuator having an actuator element that is electrically moveable with respect to the latch body between a first and second position when electrical power is applied, and that is stable in the first and second position when electrical power is removed. A lock element may be attached to the bi-stable actuator for locking the latch when the actuator element is in one of the first and second positions and unlocking the latch when the actuator element is in the other of the first and second positions. The invention provides a restraining element communicating with the actuator element to selectively resist movement of the actuator element from the second position to the first position under the influence of an accelerated force alone but allowing the movement of the bi-stable actuator from the second position to the first position during the application of electrical power alone.

Thus, it is a feature of at least one embodiment of the invention to provide a mechanism that distinguishes between forces caused by electrical actuation and forces caused by shocks, and to allow movement only in the absence of forces caused by shocks. It is another feature of at least one embodiment of the invention to provide a system that allows the bi-stable actuator to have low actuation thresholds for efficient operation and reliable operation.

The restraining element may be sensitive to the acceleration of the latch body to prevent movement of the actuator element with respect to the latch body when acceleration is detected.

Thus, it is one feature of at least one embodiment of the invention to provide a system that blocks shock movement of the lock by sensing the shock itself.

The restraining element may sense acceleration using a weight movably attached to the latch body to move with respect to the latch body under the influence of acceleration of the latch body.

It is thus a feature of at least one embodiment of the invention to provide a simple mechanical system for detecting acceleration and producing an actuation force.

The weight may communicate with a lever having a portion engaging the actuator element when the weight moves with respect to the latch body.

Thus, it is a feature of at least one embodiment of the invention to provide a mechanical system that may be easily tailored to a variety of applications.

Alternatively, the mass may communicate with the actuator element to apply a countervailing force to the bi-stable actuator opposite and no less than the accelerative force during the acceleration.

Thus, it is a feature of at least one embodiment of the invention to provide a mechanism that simply cancels out the forces of shock.

In an alternative embodiment, the restraining element may be sensitive to the application of electrical power to the bi-stable actuator to block movement of the actuator element when electrical power is not applied to the bi-stable actuator.

Thus, it is a feature of at least one embodiment of the invention to provide a mechanism that distinguishes between forces cause by electrical actuation and forces caused by shocks, and to allow movement only in the presence of forces caused by electrical actuation. It is again a feature of at least one embodiment of the invention to provide a system that allows the bi-stable actuator to have low actuation thresholds for efficient operation and reliable operation.

The restraining element may be a magnetically attracted armature moved in response to electrical power flowing through a coil.

Thus, it is a feature of at least one embodiment of the invention to provide a simple electrically actuated mechanism preventing inadvertent movement of the lock.

The bi-stable actuator may include a solenoid moving the actuator element, and the coil moving the armature described above may be the solenoid.

Thus, it is a feature of at least one embodiment of the invention to provide a simple mechanism that takes advantage of the solenoid already used as the bi-stable actuator.

The armature may be attached with the actuator element and may include a portion engaging the housing when the power is not applied to the bi-stable actuator and disengaging from the housing and actuator when the power is applied to the bi-stable actuator.

Thus, it is a feature of at least one embodiment of the invention to permit positioning of the free end of the armature near the solenoid coil as may be displaced from the actuator element.

These particular objects and advantages may apply to only some embodiments falling within the claims and thus do not define the scope of the invention.

DETAILED DESCRIPTION OF THE PREFERRED EMBODIMENT

Figure 1:
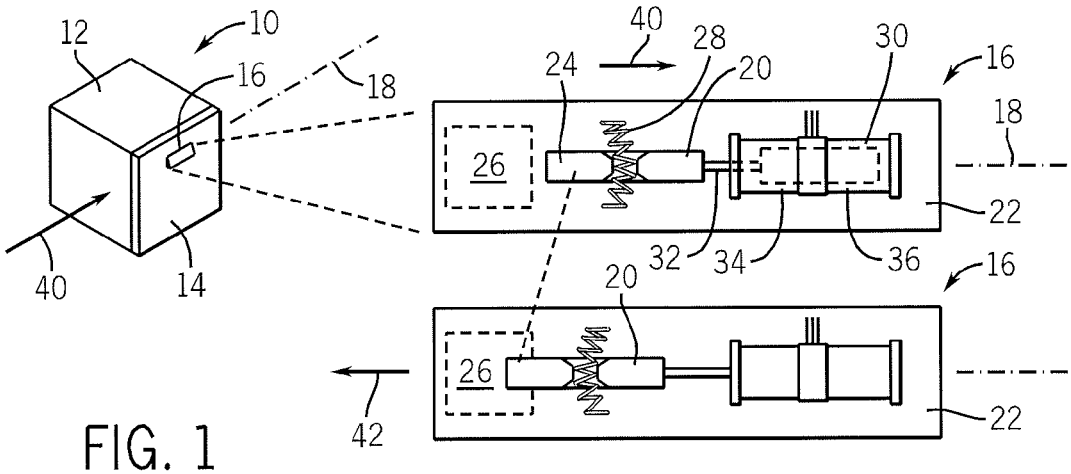
FIG. 1 PRIOR ART
FIG. 1 is a simplified perspective view of an appliance showing an orientation of a prior art bi-stable lock before and after application of a lateral acceleration caused by transportation shock resulting in locking of the lock mechanism.

Referring now to FIG. 1, an appliance 10, such as a dishwasher or washing machine, may include a cabinet 12, having a front door 14 that may be opened or closed to provide access to the interior of the cabinet.

The door 14 or cabinet 12 may provide for a lockable latch 16 extending along an axis 18 and the latch 16 may include a slide 20 moving along axis 18 with respect to a latch housing 22. One end of the slide 20 includes a locking element 24 that may engage a latching element 26, for example, a rotating hook that may receive an interconnecting element on the opposite of the door 14 or cabinet 12 to hold the two closed. The engagement of the locking element 24 with the latching element 26 prevents release of the door or cabinet.

The sliding mechanism may also attach to an over-center spring 28 that selectively urges the slide 20 to either extreme of its travel, such extremes representing the lowest energy state of the spring according to methods well known in the art. Slide 20 may be further attached to a bi-directional solenoid 30 having a magnetically attractable core 32 that may be driven in either direction along axis 18 according to one of two solenoid signals applied to a first solenoid coil 34 or to a second solenoid coil 36. Alternatively, but not shown, the solenoid may provide for a magnetized core 32 driven by different polarities of electrical signal. In operation, a first signal to the solenoid 30 drives the locking element 24 into engagement with the latching element 26 and a second signal retracts the locking element 24 from the latching element 26.

Referring still to FIG. 1, the application of a sudden acceleration 40 to the cabinet 12, may create a relative accelerative force 42 on the slide 20 causing the slide 20 to move from a state of non-engagement with the latching element 26 into engagement with the latching element 26 without application of power to the solenoid 30. It will be understood that the term accelerative force 42 is intended to cover both actual forces from acceleration 40 and relative or reactive forces tending to move the slide 20 with respect to the appliance 10 absent of the application of electrical power.

Figure 2:
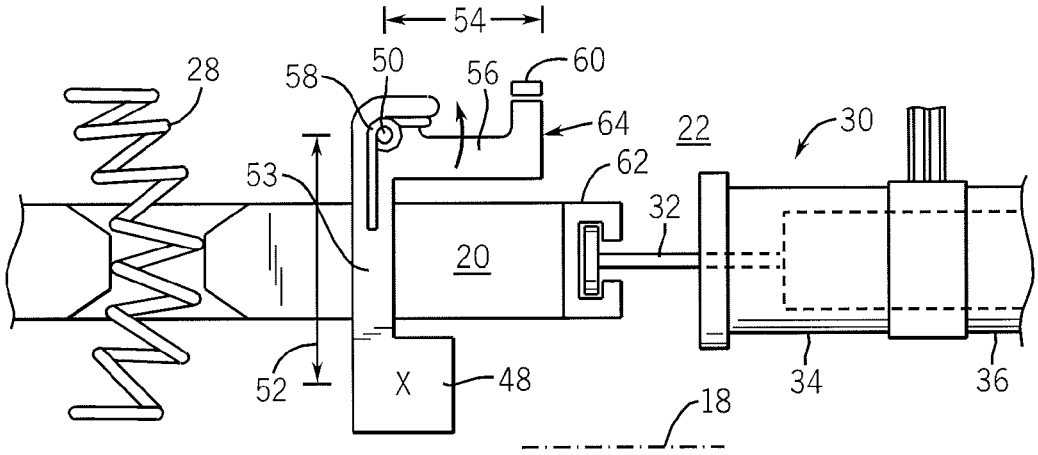
FIG. 2 is a fragmentary front elevational view of the lock of FIG. 1, including a shock-sensitive blocking lever of the present invention, shown in a state when no shock is present.

Referring now to FIG. 2, the slide 20 may rest in an unlocked state before application of any accelerative forces. In a first embodiment of the invention, a weight 48 is positioned near the slide 20 and held by an arm 53 pivoted about a pivot point 50 so that the weight 48 may move generally in a swinging radius 52 along axis 18. A lever 56 is attached to the arm 53 joining the weight 48 to the pivot point 50 at a radius 54, and, in the rest state, extending along axis 18 adjacent to the slide 20. A torsion spring 58 biases the lever 56 in a counterclockwise direction (as shown) so that one end of the lever 56 abuts a stop 60 on a lock housing preventing further motion of the lever 56 in the counterclockwise direction. The end of the lever 56 provides a blocking surface 64 adjacent to an attachment tower 62 extending upward from the slide 20 to receive one end of the core 32 of the solenoid 30.

Figure 3:
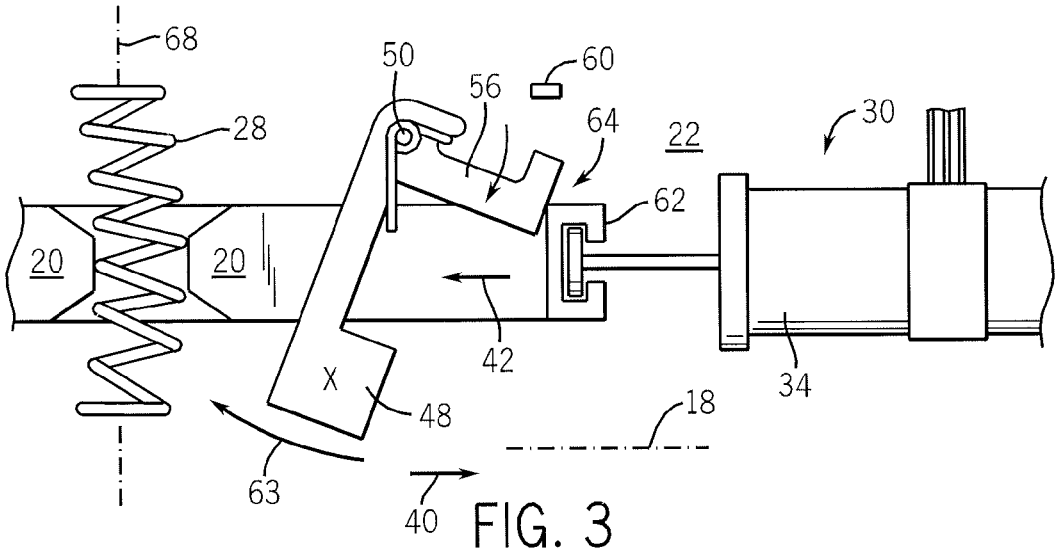
FIG. 3 is a figure similar to that of FIG. 2, showing movement of the lever to block sliding of the lock during a shock.

Referring now to FIG. 3, an acceleration 40 on the housing may apply an acceleration force on the weight 48 causing it to rotate along axis 18 as indicated by arrow 63. This, in turn, causes the lever 56 to move away from the stop 60 such that a blocking surface 64 of the lever 56 moves into the path of the attachment tower 62 preventing further axial movement to the left of the slide 20. Some motion of the slide 20 does occur, but is limited to an amount that would not flex the over-center spring 28 past a tipping point 68 where the over-center spring 28 would change state and, thus, the over-center spring 28 causes a return of the slide 20 to its rightmost position after the shock is complete.

Referring again to FIG. 2, the radii 52 and 54 of arm 53 and lever 56 and the distance between a blocking surface 64 of the lever 56 and the attachment tower 62 may be adjusted so that the blocking surface 64 engages the attachment tower 62 before significant motion of the slide 20

Figure 4:
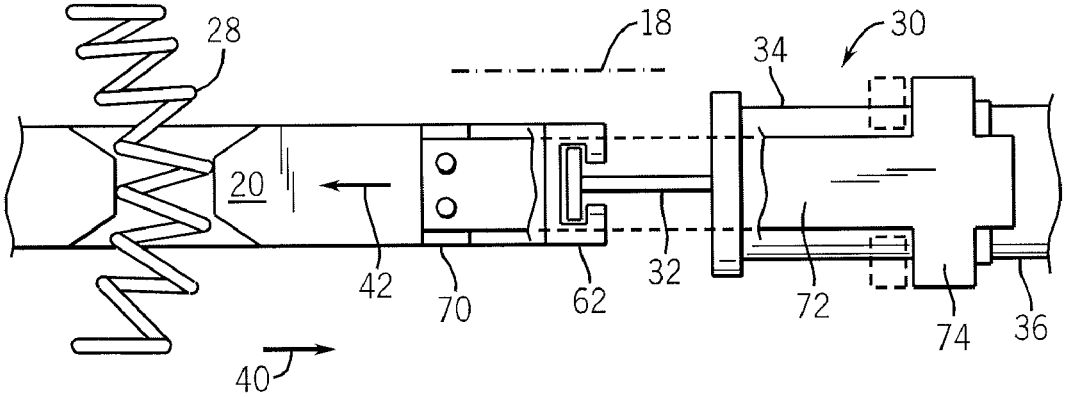
FIG. 4 is a figure similar to that of FIG. 2, showing an alternative embodiment of the invention having a magnetically attractable armature blocking a sliding of the lock when electrical power is not present.
Figure 5:
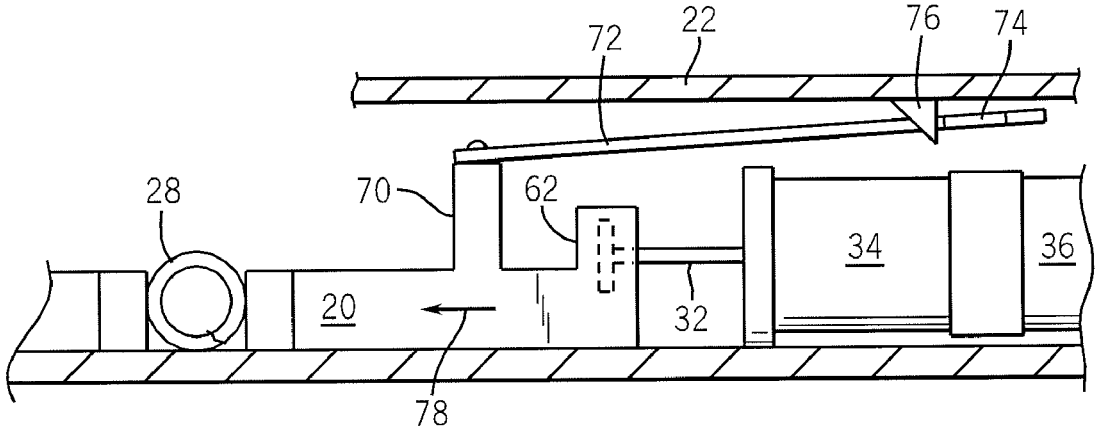
FIG. 5 is a top plan view of the embodiment of FIG. 4 showing the armature engaging blocking elements on the latch housing when electrical power is not present.

Referring now to FIGS. 4 and 5, in an alternative embodiment, the slide 20 includes an upstanding tower 70 to which is attached a thin ferromagnetic armature 72 in cantilever extending the solenoid coil 34. The free end of the armature 72 includes a crossbar 74 extending perpendicularly to the axis 18 and the general extent of the armature 72. When the slide 20 is in the unlocked state (as shown in FIG. 4), the crossbar 74 is positioned near the upper end of the solenoid coil 34 near where it abuts the lower end of solenoid coil 36.

While solenoid coil 34 is not energized (as shown in FIG. 5), the armature 72 flexes away from the solenoid coil 34 against an inner edge of an upper surface of the latch housing 22 with the crossbar 74 engaging on its leftmost edge (as depicted) the rightmost edge of a pair of stops 76 extending downwardly from the latch housing 22. In this state, axial movement by the slide 20 in direction 78 (to the left as depicted), under accelerative forces, is blocked by interengagement of the stop 76 and the crossbar 74.

Figure 6:
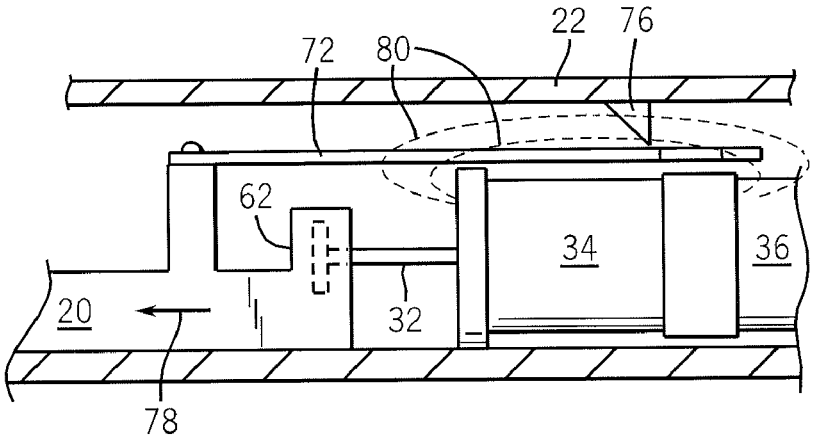
FIG. 6 is a figure similar to that of FIG. 5 showing attraction of the armature inward to allow a sliding of the lock when electrical power is present.

Referring now to FIG. 6, when solenoid coil 34 is energized, such as would naturally move the slide 20 in the direction 78 to a locked position, leakage flux 80 from the solenoid coil 34 draws the armature 72 downward pulling the crossbar 74 from blocking engagement with the stop 76 and allowing motion of the slide 20 in the direction 78. Thus, only during a period of energizing of solenoid coil 34 is the armature drawn downward so that the armature 72 and the slide 20 may move.

Stop 76 may be ramped on its left side (as shown) to allow return of the armature 72 in the unflexed state, riding against the latch housing 22, or the armature 72 may be configured to be drawn inward by the leakage flux is provided from solenoid coil 36.

Note that when the crossbar 74 is pulled downward, the latch 16 is susceptible to accelerative forces; however, normally that will not be problem as the accelerative forces occur only during shipment when the appliance is not commissioned for operation.

Figure 7:
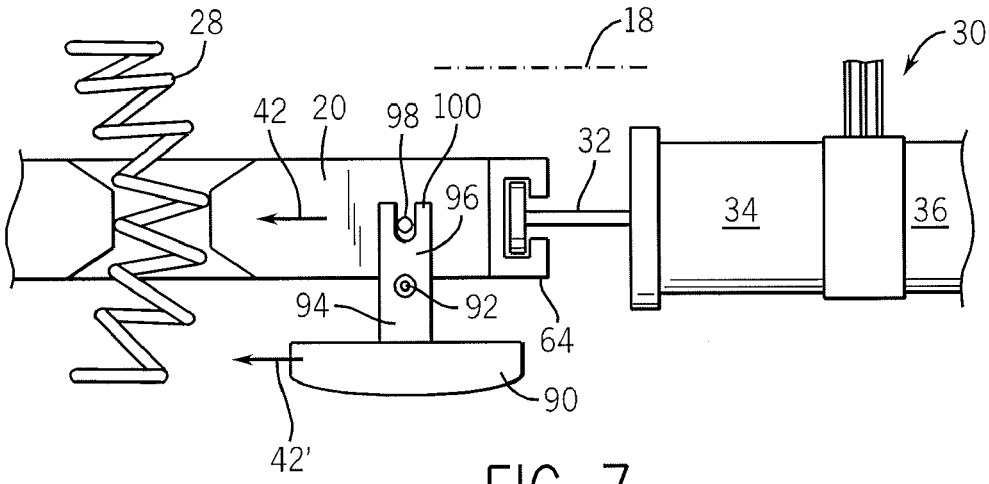
FIG. 7 is a figure similar to that of FIGS. 2 and 4, showing an embodiment having a shock force compensation weight eliminating the effect of shock forces on the slide mechanism.

Referring now to FIG. 7, in a third embodiment, the effective accelerative force 42 on slide 20 may be counteracted through the use of a compensator weight 90 pivoting about a pivot point 92 adjacent to the slide 20 so that the compensator weight 90 may rotate generally along axis 18. Compensator weight 90 connects to the pivot point 92 by means of a short lever arm 94 and then continues past the pivot point 92 in a second lever arm 96 to a point over the center of the slide 20. There, the end of the second lever arm 96 engages an upstanding peg 98 attached to the slide 20. The engagement of the second lever arm 96 and the peg 98 is by means of a slotted fork connection 100 allowing relative lateral movement between the two.

During a shock causing accelerative force 42 on the slide 20, a corresponding accelerative force 42' will act on the compensator weight 90 biasing the compensator weight 90 in a clockwise direction about pivot point 92. This, in turn, causes the fork connection 100 to apply a rightward force against peg 98 canceling or overriding accelerative force 42.

In this embodiment, the total inertia of the slide 20 is effectively increased by the compensator weight 90 increasing the short term force that must be overcome by the solenoid 30; however, the long term force necessary for locking and unlocking of the latch 16 is not affected.

It will be understood that this concept may be expanded, for example, to provide a slide 20 that integrates mass 90 and pivots about pivot point 92, for example, in a rotating equivalent to slide 20, to resist accelerative forces based on a general rotational symmetry of slide 20.

Figure 8:
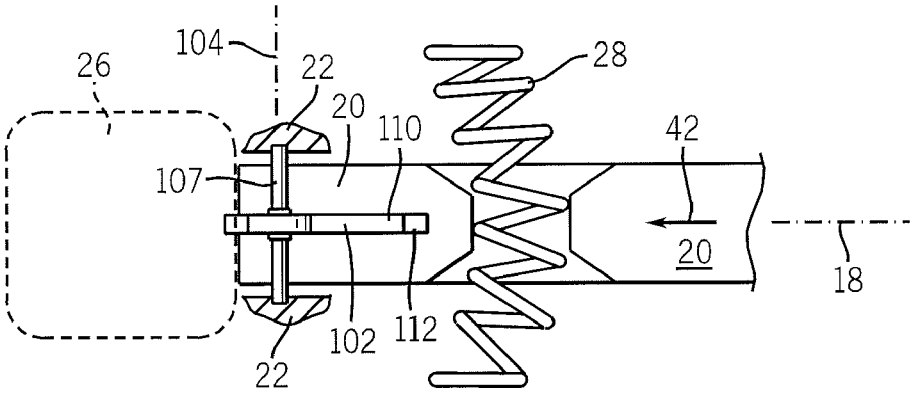
FIG. 8 is a figure similar to that of FIG. 2 showing an alternative embodiment where the blocking lever does not return to an unblocking state after the force of the shock.
Figure 9:
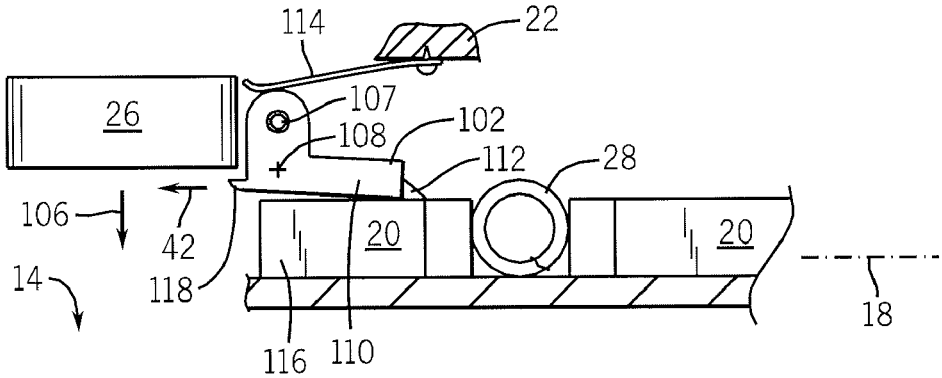
FIG. 9 is a top plan view of FIG. 9 showing a frictional element for holding the blocking lever and interaction between the blocking lever and a latching element for resetting the blocking lever.

Referring now to FIGS. 8 and 9, in an alternative embodiment similar to that of the embodiment of FIGS. 2 and 3, a lever 102 may be attached to the housing 22 to rotate about an axis 104 perpendicular to axis 18 and perpendicular to axis 106 generally aligned with a line of action of an opening door 14 of the appliance 10.

The lever 102 pivots about a shaft 107 positioned behind a center of gravity 108 of the lever 102, so that accelerative force 42 causes a generally clockwise motion of the lever 102 (according the orientation of FIG. 9). This rotation causes a lever arm 110 of the lever 102 to engage a tooth 112 extending from the slide 20 preventing motion of the slide under the accelerative force 42 in a manner analogous to the engagement of blocking surface 64 with the attachment tower 62 described with respect to FIG. 2.

Unlike the embodiment of FIG. 2, however, in this embodiment there is no torsion spring 58 and so after the clockwise rotation caused by the accelerative force 42, the lever arm 110 remains engaged with the tooth 112. Friction, resisting motion of the lever 102, may be controlled and augmented by a leaf spring 114 pressing downward from the housing 22 on a surface of the lever 102.

A locking of the latching element 26 (preventing the door 14 from opening) requires engagement of a portion 116 of the slide 20 in front of the latching element 26 such as prevents movement of the latching element 26 along axis 106 beyond a certain point that would allow opening of the door 14. Thus, the first accelerative force 42 blocks the slide 20, locking the latching element 26 indefinitely. An advantage of this design is that there is reduced chance that multiple shocks will in some instance defeat the preventative action of the lever 102.

Referring to FIG. 9, the lever arm 110 may be disengaged with the tooth 112 so that the slide 20 is again free to move (and lock the latching element 26) upon the attempted opening of the door 14. This opening serves to pull the latching element 26 along the axis 106 so that the latching element 26 engages a tooth 118 or other surface on the lever 102 rotating the lever 102 in a counterclockwise direction against the friction provided by the leaf spring 114.

It is specifically intended that the present invention not be limited to the embodiments and illustrations contained herein, but include modified forms of those embodiments including portions of the embodiments and combinations of elements of different embodiments as come within the scope of the following claims.

We claim:

1. A latch for a door of a household appliance subject to transportation shocks comprising:

a housing a latching element supported by the housing to move with respect to the housing between at least two positions a first holding the door closed and a second allowing the door to open;

a bi-stable actuator supported by the housing and having an actuator element electrically movable with respect to the housing between a first and second position with an application of momentary electrical power, and after movement to either of the first and second positions, being indefinitely stable in either one of the first and second positions when the momentary electrical power ceases;

a lock element attached to the bi-stable actuator for locking the latching element when the actuator element is in the first position to hold the door closed and unlocking the latching element when the actuator element is in the second position allowing the door to open; and a restraining element selectively resisting movement of the actuator element from the second position to the first position under an influence of an accelerative force alone without the application of momentary electrical power, where the accelerative force is directed so that it would move the actuator element but for the operation of the restraining element, but allowing the movement of the actuator element from the second position to the first position during the application of electrical power alone without the application of the accelerative force.

2. The latch of claim 1 wherein the restraining element is sensitive to acceleration of the latch body to prevent the movement of the actuator element with respect to the latch body when acceleration is detected.

3. The latch of claim 2 wherein in the restraining element senses acceleration using a weight attached to the latch body to move with respect to the latch body under the influence of acceleration of the latch body.

4. The latch of claim 3 wherein the weight communicates with a lever having a portion engaging the actuator element when the weight moves with respect to the latch body.

5. The latch of claim 4 further including a spring operating to return the lever to a state of disengagement with the actuator element when the weight is not under the influence of acceleration.

6. The latch of claim 4 where the lever remains engaged with the actuator element after the weight is under the influence of acceleration.

7. The latch of claim 6 further including a leaf spring providing a frictional resistance to motion of the lever, to hold the lever engaged with the actuator element after the weight is under the influence of acceleration.

8. The latch of claim 6 where the lever interacts with a latch element to disengage from the actuator element when a user attempts to open a door held by the latch.

9. The latch of claim 1 wherein the restraining element is sensitive to the application of electrical power to the bi-stable actuator to block the movement of the actuator element when electrical power is not applied to the bi-stable actuator.

10. The latch of claim 9 wherein the restraining element is a magnetically attracted armature moved in response to electrical power flowing through a coil.

11. The latch of claim 10 wherein the bi-stable actuator includes a solenoid moving the actuator element and wherein the coil is the solenoid.

12. The latch of claim 11 wherein the armature is attached to move with the actuator element and includes a portion engaging the housing when power is not applied to the bi-stable actuator and disengaging from the housing when power is applied to the bi-stable actuator.

13. The latch of claim 10 wherein the armature is a spring flexed under a magnetic field.

14. The latch of claim 1 wherein the restraining element is a mass responsive to an acceleration producing the accelerative force and communicating with the actuator element to apply a countervailing force to the bi-stable actuator opposite and no less than the accelerative force during the acceleration.

15. The latch of claim 14 wherein the mass is positioned on one end of a lever and an opposite end of the lever is attached to the bi-stable actuator operator.

16. The latch of claim 1 wherein the bi-stable actuator is a bi-directional solenoid.

17. The latch of claim 1 wherein the bi-stable actuator includes an over-center spring mechanism urging the bi-stable actuator toward the first position when the bi-stable actuator is close to the first position and urging the bi-stable actuator toward the second position when the bi-stable actuator is close to the second position.

18. The latch of claim 1 wherein the lock element locks the latch in the first position.

19. The latch of claim 9 wherein the restraining element is a magnetic armature movably positioned between the housing and the restraining element and responsive to a magnetic fields produced when power is applied to the bi-stable actuator, the restraining element moving under the influence of magnetic force to release the restraining element when power is applied to the bi-stable actuator.

* * * * *

UNITED STATES PATENT AND TRADEMARK OFFICE

CERTIFICATE OF CORRECTION

PATENT NO. : 7,900,979 B2
APPLICATION NO. : 11/684287
DATED : March 8, 2011
INVENTOR(S) : Joel C. Bragg et al.

It is certified that error appears in the above-identified patent and that said Letters Patent is hereby corrected as shown below:

| | |
|---|---|
| Col. 4, line 67 | After "slide 20" insert -- occurs. The weight 48 and force of torsion spring 58 can also be adjusted for this purpose. -- |

Signed and Sealed this
Twenty-eighth Day of August, 2012

David J. Kappos

David J. Kappos
*Director of the United States Patent and Trademark Office*